US008992119B2

(12) United States Patent
Parsons, Jr. et al.

(10) Patent No.: US 8,992,119 B2
(45) Date of Patent: Mar. 31, 2015

(54) MACHINE FOR RECLAIMING AND RECYCLING ROADWAY SHOULDER MATERIAL WHILE RESTORING SHOULDER GRADE AND LEVEL

(71) Applicant: R. L. Parsons and Son Equipment Company, Inc., West Jefferson, OH (US)

(72) Inventors: Ralph L. Parsons, Jr., West Jefferson, OH (US); Ralph L. Parsons, III, West Jefferson, OH (US); Carl Eby, West Jefferson, OH (US)

(73) Assignee: R.L. Parsons And Son Equipment Company, Inc., West Jefferson, OH (US)

( * ) Notice: Subject to any disclaimer, the term of this patent is extended or adjusted under 35 U.S.C. 154(b) by 0 days.

(21) Appl. No.: 14/090,604

(22) Filed: Nov. 26, 2013

(65) Prior Publication Data

US 2014/0147207 A1 May 29, 2014

Related U.S. Application Data

(60) Provisional application No. 61/730,572, filed on Nov. 28, 2012.

(51) Int. Cl.

| | |
|---|---|
| ***E01C 23/16*** | (2006.01) |
| ***E01C 23/06*** | (2006.01) |
| ***E01C 23/088*** | (2006.01) |
| ***E01C 23/09*** | (2006.01) |

(52) U.S. Cl.

CPC ..... *E01C 23/065* (2013.01); *E01C 23/088* (2013.01); *E01C 23/09* (2013.01)

USPC ..... 404/91

(58) Field of Classification Search

USPC ..... 404/90, 91, 93, 94, 96

See application file for complete search history.

(56) References Cited

U.S. PATENT DOCUMENTS

| | | | | |
|---|---|---|---|---|
| 3,375,765 | A | 4/1968 | Hanson | |
| 3,971,148 | A | 7/1976 | Deal | |
| RE29,356 | E | 8/1977 | Bennett | |
| 4,186,968 | A * | 2/1980 | Barton | 299/39.2 |
| 4,701,069 | A * | 10/1987 | Whitney | 404/75 |
| 4,702,644 | A | 10/1987 | Cioffi | |
| 4,933,853 | A | 6/1990 | Musil et al. | |
| 5,791,814 | A | 8/1998 | Wiley | |
| 6,213,560 | B1 * | 4/2001 | Lindblom | 299/39.4 |
| 6,227,620 | B1 | 5/2001 | Page | |
| 6,299,381 | B1 | 10/2001 | Liebrecht, Jr. | |
| 7,789,587 | B2 | 9/2010 | James | |
| 8,573,885 | B2 * | 11/2013 | Latham | 404/94 |

(Continued)

*Primary Examiner* — Abigail A Risic

(74) *Attorney, Agent, or Firm* — Frank H. Foster; Kremblas & Foster

(57) ABSTRACT

A grader blade mounted to a support frame has an auger-grinder mounted ahead of the grader blade. The auger-grinder has a first helical vane fixed to a rotatable axle with a plurality of teeth attached to and protruding outwardly from the auger. A shroud above and partially surrounding the auger-grinder has an inner shroud end wall, an outer shroud end wall and bearings in which the axle is journaled transverse to the direction of travel. A beater is fixed to the axle between an inner end of the helical vane and the inner wall. The beater has a plurality of paddles extending outwardly from the axle. An inner barrier wall is attached to the inner shroud wall and extends forward of the auger-grinder. A drive link is connected to the axle for connection to a prime mover for driving the axle in rotation.

7 Claims, 5 Drawing Sheets

(56) References Cited

U.S. PATENT DOCUMENTS

| | | | | |
|---|---|---|---|---|
| 2004/0005190 | A1* | 1/2004 | Jakits | 404/75 |
| 2008/0008527 | A1* | 1/2008 | Kraemer et al. | 404/94 |
| 2008/0292399 | A1* | 11/2008 | Freeburn | 404/90 |
| 2012/0243939 | A1* | 9/2012 | Oxford et al. | 404/90 |
| 2013/0322963 | A1* | 12/2013 | Forster et al. | 404/75 |
| 2014/0147207 | A1* | 5/2014 | Parsons et al. | 404/91 |
| 2014/0270956 | A1* | 9/2014 | Seovic | 404/93 |

* cited by examiner

MACHINE FOR RECLAIMING AND RECYCLING ROADWAY SHOULDER MATERIAL WHILE RESTORING SHOULDER GRADE AND LEVEL

CROSS-REFERENCES TO RELATED APPLICATIONS

This application claims the benefit of U.S. Provisional Application No. 61/730,572 filed Nov. 28, 2012, which is incorporated herein by reference.

STATEMENT REGARDING FEDERALLY-SPONSORED RESEARCH AND DEVELOPMENT (Not Applicable)

THE NAMES OF THE PARTIES TO A JOINT RESEARCH AGREEMENT (Not Applicable)

REFERENCE TO AN APPENDIX (Not Applicable)

BACKGROUND OF THE INVENTION

This invention relates generally to earth moving and shaping equipment and more particularly relates to a machine that restores a sunken roadway shoulder to the level of a roadway edge and provides a downward grade for rainwater drainage away from the roadway using only pre-existing shoulder material that is lying in place in a depressed and deteriorated shoulder at the time of the restoration.

Roadways are constructed of a relatively hard material for supporting vehicle traffic. They are typically constructed of pavement, such as asphalt or concrete, or of gravel that has been compacted from years of use to create a hard, smooth and relatively permanent path that resists erosion and softening from rain water. Most roadways also have parallel shoulders running along and adjacent both sides of the roadway and interposed between the roadway itself and a ditch and/or grass along the outer sides of the right-of-way. The shoulders provide strips that border the roadway in order to support vehicle wheels that stray off the roadway as a result of driver inattention, distraction, the need to pass oppositely moving traffic on a narrow roadway or for other reasons. The shoulders of most local, township, county and some state roads are composed of gravel, dirt or, most commonly, an aggregate mixture of both because these materials are less costly than roadway materials.

Because vehicle wheels occasionally stray from the roadway onto the shoulder, it is desirable that the shoulder that is adjacent the roadway meets the roadway at the same level as the pavement or gravel roadway. That allows a smooth transition between the roadway and the shoulder and avoids a ridge at the edge of the roadway that can deflect the steering of the vehicle and resist the return of vehicle wheels to the roadway. Roadways are also contoured with a central crown to enhance water drainage from the roadway. Desirably, the shoulder smoothly continues the downward grade away from the roadway in order to permit water drainage from the roadway to pass across the shoulder.

Unfortunately, over a period of time the level of the shoulder descends below the level of the edge of the roadway as a result of compression and outward displacement of shoulder materials resulting from the weight of vehicle wheels running off the road and from outward erosion of the shoulder material caused by rain water drainage from the roadway. This displacement and compression of the shoulder material leaves an undesirable and potentially hazardous ridge along the edge of the roadway. Similarly, when a roadway is replaced with new pavement, the edge of the new pavement may be at a higher level than the dirt and gravel adjacent to the roadway leaving the same kind of ridge.

The development of such roadway edge ridges requires maintenance by highway crews of the responsible governmental agency. The maintenance is conventionally accomplished by depositing new shoulder material, typically gravel, adjacent the roadway. This conventional maintenance requires the expense of new gravel and a labor intensive effort to position the new gravel in place and to level and grade the new gravel so that it has the desirable shoulder grade and level describe above. Typically, this maintenance is accomplished by slowly driving a gravel filled dump truck along the roadway. A chute that extends sideward from the truck cargo bed allows the new gravel to flow onto the shoulder. Workmen then walk along and shovel, rake and/or hoe the gravel into the desired grade and level. Because the gravel falls from the chute or is shoveled onto the shoulder in an uneven distribution and height, the process of properly contouring the gravel is labor intensive work. Often this manual contouring of the new gravel results in a transition with the roadway in which the level of the gravel varies between too high and too low. Additionally, the manual operation commonly leaves a considerable quantity of gravel lying on the roadway surface along its edge. As a result, a workman with a broom must follow along and sweep the gravel material outward from the roadway onto the shoulder. It is not unusual for this conventional maintenance operation to require four or more workers who move at a relatively slow pace along the roadway.

Therefore, there is a need for a machine that eliminates the need for the addition of new gravel, that reduces the number of required workers in order to reduce the cost of this maintenance, that speeds up the maintenance process, that improves the quality of the grading and level of the restored shoulder, that allows adjustment of the level and grade of the restored shoulder and that allows adjustable control of the level of the shoulder at its interface with the roadway. The present invention accomplishes all of those advantages. With the present invention, a single operator in one pass along the roadway recycles shoulder material that is already located in its displaced locations along the roadway and leaves a strip of loosened material having a predetermined and controllable thickness and contour with only very minor spillage onto the hard roadway. The single pass of the machine of the invention also leaves the loosened and recycled material at a uniform and controllably adjustable height above the edge of the pavement. That controllable height permits the loosened material along the shoulder to be compressed by simply driving the tires of a dump truck, preferably loaded for additional weight, along the recycled shoulder material to compress it to the level of the roadway edge to restore the shoulder to the desirable shoulder level and grade.

BRIEF SUMMARY OF THE INVENTION

The invention is a machine for continuously restoring a roadway shoulder while concurrently reclaiming pre-existing shoulder material and recycling the reclaimed material into the restored shoulder. The machine includes a support frame movable in a direction of travel along a roadway. A grader blade is mounted to the support frame, oriented transversely of the direction of travel and is adjustably rotatable about an axis along the direction of travel for tilting the blade with respect to the transverse surface of the roadway. An auger-grinder is mounted to the grader blade or the support frame and comprises an auger having a first helical vane fixed to a rotatable axle with a plurality of teeth attached to and protruding outwardly from the auger. A shroud is mounted above and partially surrounds the auger-grinder. The shroud has an inner shroud end wall, an outer shroud end wall and bearings in the shroud end walls in which the axle is journaled between the end walls and oriented transverse to the direction of travel. A beater is also fixed to the axle between an inner end of the helical vane and the inner wall. The beater has a plurality of paddles extending outwardly from the axle. An inner barrier wall is attached to the inner shroud wall and extends forward of the auger-grinder. A drive link is connected to the axle for connection to a prime mover for driving the axle in rotation.

Figure 1:
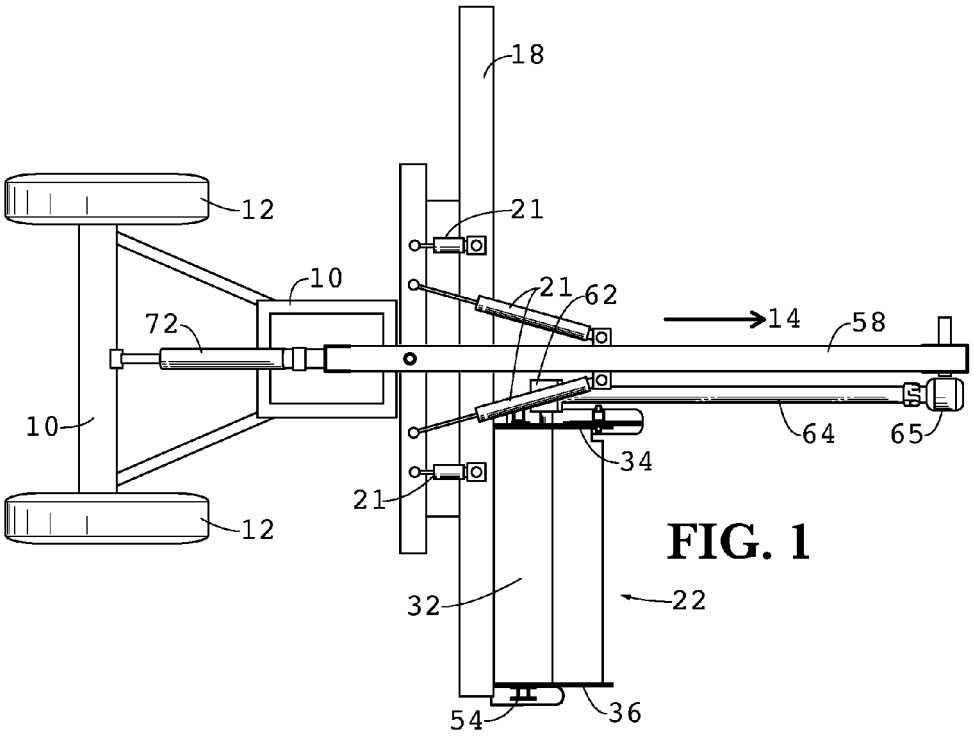
FIG. 1 is a top plan view of the preferred embodiment of the invention.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Figure 2:
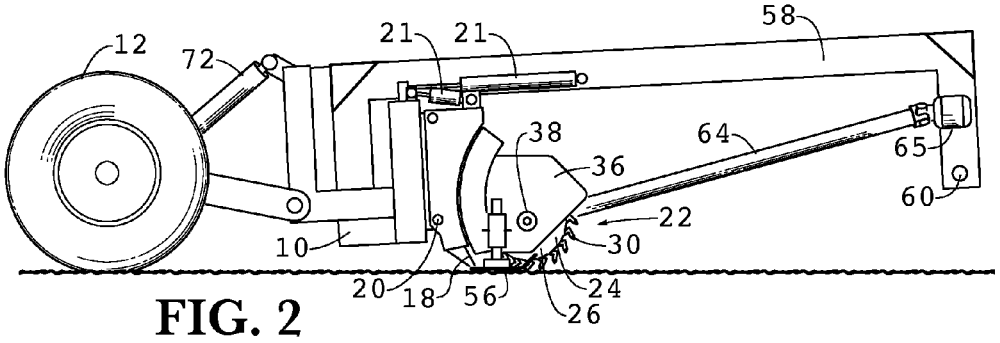
FIG. 2 is a view in side elevation of the embodiment of FIG. 1.
Figure 3:
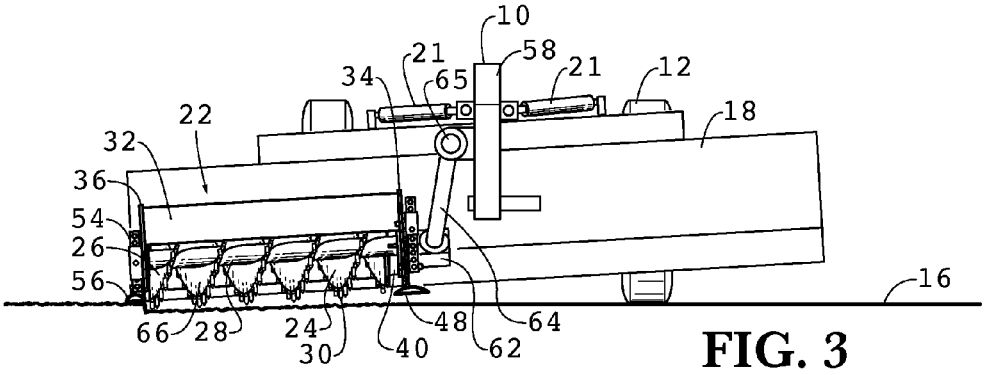
FIG. 3 is a view in front elevation of the embodiment of FIG. 1.
Figure 4:
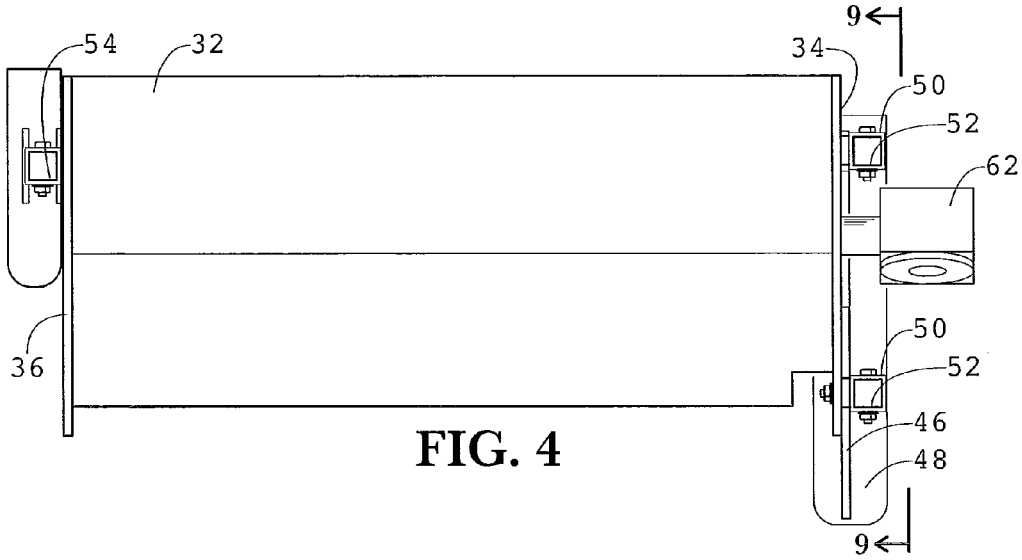
FIG. 4 is a top plan view of the shoulder grinding and material moving unit that is a component of the embodiment of FIG. 1.

FIGS. 1 through 3 illustrate an embodiment of the invention that continuously restores a roadway shoulder from shoulder material that continuously recycles from the preexisting, sunken shoulder material already in place along the roadway. The machine loosens and reclaims the pre-existing shoulder material, moves the reclaimed material closer to the roadway and contours the upper surface of the displaced shoulder material all in a single pass along the shoulder.

Referring to the drawing figures, a main support frame 10 is supported on wheels 12 and drawn by a tractor in a direction of travel 14 along a roadway 16. A grader blade 18 is mounted to the support frame 10 and is oriented transversely of the direction of travel 14. The grader blade 18 is adjustably rotatable about a central axis that is parallel to the direction of travel so that the blade 18 can be laterally tilted with respect to the transverse contour of the roadway in the manner illustrated in FIG. 10. The grader blade 18 is also rotatably mounted to the frame 10 by hinge pins 20 for pivotal adjustment around a transverse axis. These two rotatable adjustments of the grader blade 18 are controlled in the conventional manner by common hydraulic cylinders 21. The height of the grader blade 18 is also preferably vertically adjustable above the ground surface. Graders with frames and wheels that are constructed and function in the manner described above are known in the prior art for the purpose of grading and therefore the support frame and grader components are not described in more detail. The remaining components of the embodiment of the invention are attached to the assembled frame, wheels and grader blade so that the assembly is a component of the invention which advantageously uses its adjustable features.

A shoulder grinding and material moving unit 22 is attached to the support frame 10 preferably indirectly by attachment to the grader blade 18, but it could alternatively be attached directly to the frame ahead of the blade 18. As will be described, the shoulder grinding and material moving unit 22 is pulled along a roadway shoulder. The unit 22 can be located at either end of the blade 18. The preferred end is determined by whether the operator prefers to travel along the shoulder in the normal direction of vehicle travel in the lane adjacent to the shoulder being treated or prefers to travel opposite to the normal direction of vehicle travel. It is desirable that the machine ride as much as possible on the roadway during operation to avoid the irregular contours of the terrain beyond the roadway shoulder so that the reconstructed shoulder is a smoothly joined extension of the roadway grade. The illustrated embodiment is arranged so that the frame 10 and the blade 18 extend well onto the roadway, travel in the normal direction of vehicle travel and extend on the right side onto the adjacent shoulder so that the shoulder grinding and material moving unit 22 travels along the shoulder.

Because the blade 18 and the unit 22 are oriented laterally of the direction of travel and the unit 22 can be at either end of the blade 18, it is convenient to refer to the inner and outer ends of the unit 22. With this terminology convention, the part of the machine that operates on the part of the shoulder that is farthest from the roadway can be described as the "outer" end of the machine and the part of the machine that operates on the part of the shoulder that is adjacent the roadway and nearer the center of the roadway can be described as the "inner" end. In other words, "inner" refers to closer to the center of the roadway during normal operation and "outer" refers to laterally further from the center of the roadway during normal operation. The terms "forward" or "ahead" as well as "aft" or "behind" are also used to indicate position with respect to the direction of travel 14 of the machine. The terms "left" and "right" are used in the same manner as conventionally used to refer to sides of a vehicle with respect to its forward direction of travel.

It will also become apparent from the description of the invention that the blade 18 is not required to extend the entire lateral width of the frame 10. The preferred embodiment has a conventional blade 18 because that is conveniently commercially available. However, for the invention, it is only necessary that the grading blade extend the width of the shoulder grinding and material moving unit 22. Consequently, a blade that is laterally shorter than the illustrated blade 18 can be used with an accompanying shoulder grinding and material moving unit 22 that can be positioned on either side of the support frame 10 or at its center. The lateral location of the blade 18 and the unit 22 depends upon the desired direction of travel along the roadway lane that is adjacent to the shoulder being treated and upon how far the designer wants the embodiment of the invention to extend onto the roadway during operation.

The shoulder grinding and material moving unit 22 has a rotatable auger-grinder 24 mounted ahead the grader blade 18. The auger-grinder 24 comprise an auger formed by a first helical vane 26 fixed to a rotatable axle 28 with a plurality of teeth 30 attached to and protruding outwardly from the outer peripheral edges of the helical vane 26. Preferably the teeth 30 are replaceable and are tungsten carbide tipped asphalt bit teeth, such as commonly used to cut up asphalt pavement for recycling.

The shoulder grinding and material moving unit 22 also includes a shielding shroud 32 that is mounted above and partially surrounds the auger-grinder 24 and has an inner shroud end wall 34 and an outer shroud end wall 36. The shroud 32 is preferably bolted or welded to the blade 18. The shroud 32 extends over the top and downwardly along its forward and aft boundaries to cover the helical auger-grinder 24 so that the shroud 32 will reflect pre-existing shoulder material from an upward trajectory as the pre-existing shoulder material is being chopped up by the teeth 30 and being moved inwardly by the rotating helical vane 26. The shroud 32 is preferably constructed of sufficiently strong, thick and structurally rigid steel plate that it does not need separate framing members, although thinner material could be used with suitable framing.

Axle bearings 38 are mounted to the shroud end walls 34 and 36 so that the axle 28 is journaled between the end walls 34 and 36 with the axle 28 oriented transverse to the direction of travel.

Importantly, a beater 40 is fixed to the axle 28 between an inner end of the helical vane 26 and the inner shroud wall 34. The beater 40 has a plurality of paddles 42 extending outwardly from the axle 28. The preferred beater 40 has four radially oriented paddles 42 arranged with a 90° angular spacing about the axle 28 with each paddle 42 welded along a radial edge to a circular plate 44. The beater 40 and its circular plate 44 should be positioned close to, (e.g. one quarter inch from) the inner shroud wall 34 to keep rock and grit away from the bearings. The radius of the beater 40 should be less than the radius of the auger-grinder 24 at the tips of its teeth 30, preferably about 1.5 inches less.

The beater 40 is very important to the proper function of the invention. The beater 40 helps limit or stop the sideward movement of material that is being moved laterally inward by the auger-grinder 24. The beater 40 deflects and throws the particulate shoulder material upward, forward and aft and also throws the material downwardly to make a curtain of downwardly moving particles that limit the amount of material that is thrown onto the roadway. The beater 40 breaks up clumps of ground-up shoulder material and pulverizes it so that it is deposited as a relatively fine granular material that can be easily smoothed by the grader blade 18 to a uniform surface at a desired level and grade.

Figure 7:
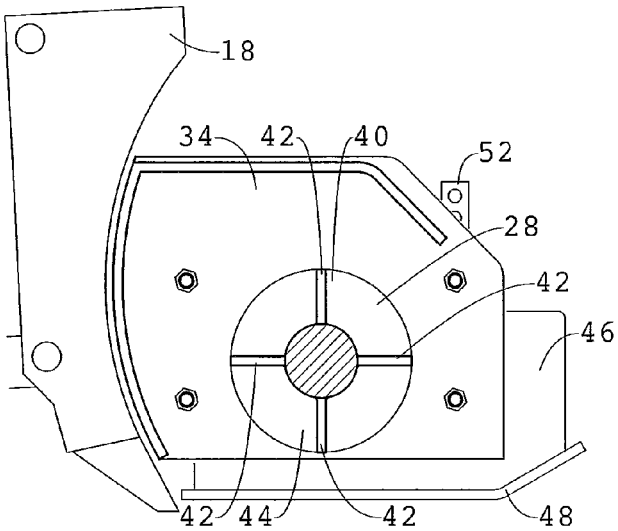
FIG. 7 is a view in vertical section of the component of FIG. 4, taken substantially along the line 7-7 of FIG. 5.
Figure 8:
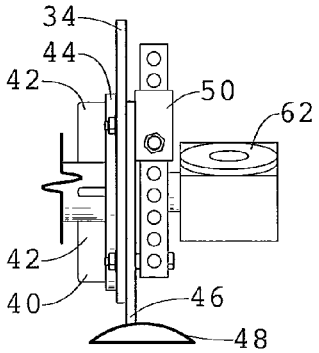
FIG. 8 is a view in front elevation of the structure illustrated in FIG. 7.
Figure 9:
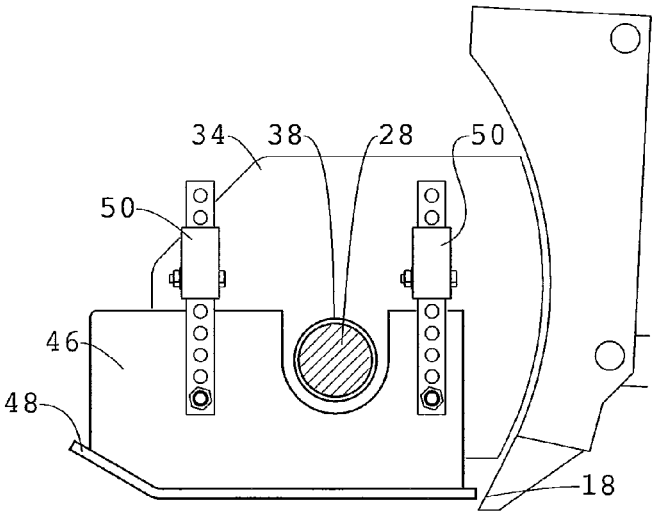
FIG. 9 is a view in side elevation of the structure illustrated in FIG. 7 but looking in a direction opposite the view direction of FIG. 7.

An inner barrier wall 46 (most detailed in FIGS. 7-9) is attached to the inner shroud end wall 34 and extends forward of the auger-grinder 24. A catch flange 48 is attached to the bottom edge of the inner barrier wall 46 and aligned along the direction of travel 14. The catch flange 48 extends from the bottom of the inner barrier wall 46 laterally outward in a direction toward the auger-grinder 24. The catch flange 48 has the important function of blocking pieces of the granular shoulder material that are thrown downwardly by the rotating beater, especially those pieces that are propelled along a trajectory that has a lateral component toward the roadway. In operation, the catch flange rides 3 to 5 inches above the roadway and minimizes the amount of shoulder material that is deposited upon the edge of the roadway. Advantageously, the catch flange 48 also extends inwardly from the inner barrier wall 46 to which it is welded (i.e. in a direction away from the auger grinder 24) to form a shoe that can rest upon the ground when the machine is not in use.

The inner barrier wall 46, and therefore the position of the catch flange 48, is vertically adjustable with respect to the shroud inner end wall 34 for fixing the catch flange 48 at a selected distance lower than radial extremities of the beater. As will be seen, in operation the auger-grinder 24 along with the blade 18 can be adjusted as a unit to a desired lateral inclination to the pre-existing shoulder and roadway. They can also be adjusted to a desired level in order to control the depth of the grinding into the shoulder and the height or level of ground-up shoulder material that is deposited adjacent to the roadway. During operation, the height of the bottom of the inner barrier wall 46 and the height of the catch flange 48 above the roadway control the amount of ground shoulder material that spills onto the roadway. Consequently, the inner barrier wall 46 is vertically adjustable so that the catch flange 48 can be positioned at the desired height above the roadway after the inclination and level of the blade 18 and the auger-grinder 24 are selected. Typically, some trial, error and readjustment of all of the adjustable parameters is required during the initial stages of shoulder restoration.

The inner barrier wall 46, which is a barrier to inward movement of loosened shoulder material, importantly also extends forwardly of the teeth 30 of the auger-grinder 24. For example, the inner barrier wall 46 should extend forward a distance that is in the range of 6"-20" and preferably about 12". This forwardly extending wall along with the catch flange 48 retains shoulder material, which accumulates and builds up ahead of the operating auger-grinder 24, against flowing laterally inward onto the roadway.

In order to provide the desired vertical adjustability of the inner barrier wall 46, it is attached to the inner shroud wall 34 by two pin type jacks. Each pin type jack has a short outer tube 50 welded to the exterior of the shroud inner end wall 34 through which a mating longer tubular leg 52 is vertically slidable. The longer tubular legs 52 have a longitudinal series of holes and the outer tubes 50 have corresponding holes through which a pin can be inserted when the legs 52 are slid to the desired adjustment and the holes are aligned in order to retain the inner barrier wall 46 at the vertically adjusted position. Alternatively, the inner barrier wall and its forward extending wall could be formed unitarily as extensions of the shroud inner end wall 34 but that would undesirably sacrifice the advantages of adjustability.

Figure 5:
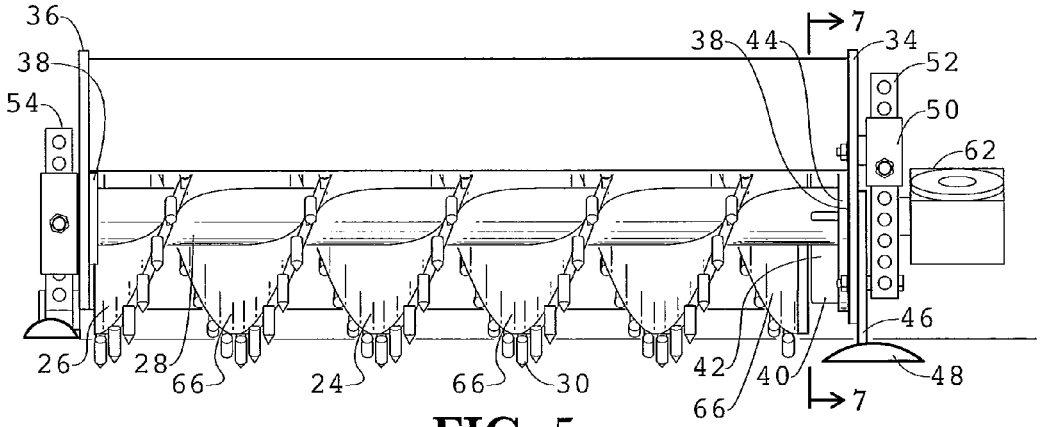
FIG. 5 is a view in front elevation of the component of FIG. 4.
Figure 6:
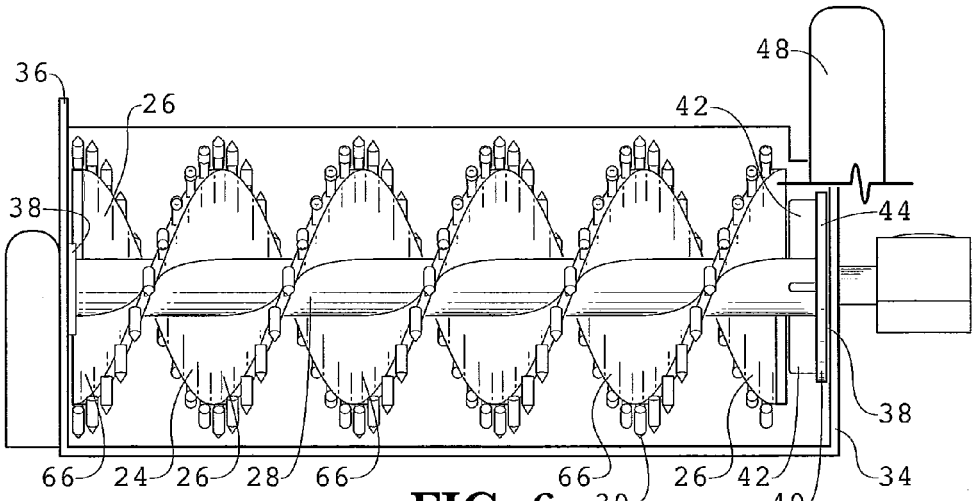
FIG. 6 is a bottom view of the component of FIG. 4 with its inner barrier wall and part of its catch flange removed to reveal structures above them.
Figure 10:
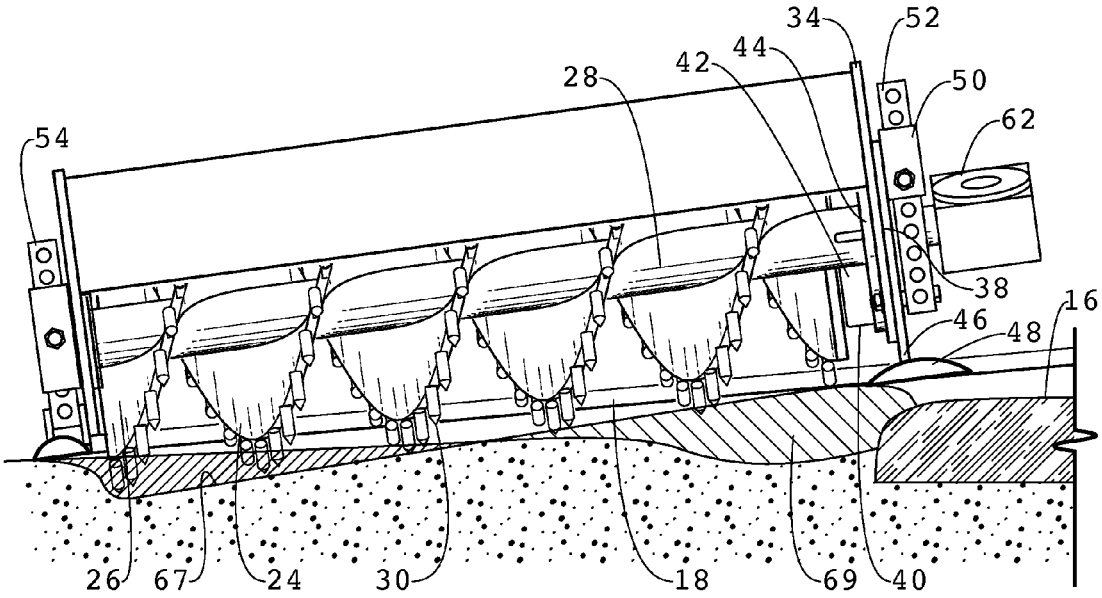
FIG. 10 is a view in front elevation of the shoulder grinding and material moving unit illustrated in FIGS. 4-6 in an operating position digging and transporting shoulder material for restoring the shoulder.

Attached to the opposite outer shroud end wall 36 is a downwardly extending vertically adjustable outer leg 54 that has a shoe 56 pivotally mounted at its bottom end. The vertically adjustable outer leg 54 is formed by the same pin type jack that is described above and attached to the outer shroud end wall 36 and adjusted in the same manner. In operation, the shoe 56 rides along the pre-existing shoulder outward of the auger-grinder 24. The vertically adjustable outer leg 54 and the shoe 56 carried by it allow for adjustment of the depth that the teeth 30 of the auger-grinder 24 dig or bite into the surface of the outermost strip of pre-existing shoulder. As can be seen in FIGS. 3, 5 and 10, the teeth 30 are at a lower level than the bottom of the shoe 56. The shoe 56 is normally set to the same level as the lower edge of the blade 18. In operation, the shoe 56 rides on the preexisting shoulder surface outward from the shoulder restoration so that the alignment of the bottom of the grader blade 18 at the same level as the bottom of the shoe 56 allows the grader blade to leave a smooth transition between the pulverized shoulder material and the adjacent untouched shoulder. The shoe 56 pivots about a lateral axis so that it can follow minor hills and valleys that it may encounter as it slides along the shoulder and also so that it will ride along the shoulder and not dig in when the blade 18 is pivoted around a lateral axis in order to lower the auger-grinder deeper into the preexisting shoulder.

The lateral length of the shoulder grinding and material moving unit 22 and the length of the auger-grinder 24 in a direction transverse to the direction of travel, preferably is approximately the width of the shoulder that its operator desires to reclaim and regrade. The length of the auger-grinder 24 is a little less that the distance between the shroud 32 end walls so that there is space on the axle for the beater.

Embodiments of the invention require a drive link that is connected to the axle 28 and can be connected (or is permanently connected) to a prime mover that drives the axle 28 in rotation. The preferred support frame 10 has a tongue 58 with a hitch 60 for attachment to and for being pulled by a farm type tractor. Although the world has many implements pulled by farm tractors, there are substantial cost saving advantages with moving and powering embodiments of the invention in this manner. Although embodiments of the invention can be constructed as self-powered dedicated equipment, embodiments of the invention do not require anywhere near the drive power required for road surface chopping equipment because embodiments of the invention are operating upon softer shoulder material along a strip of narrower width. A substantial advantage of a tractor drawn machine that embodies the invention is that the forward opening beneath the shroud 32 and into the auger-grinder 24 is always easily visible to the tractor operator. That visibility allows the operator to continuously monitor the amount of ground shoulder material that accumulates in front of the auger-grinder 24, especially adjacent to the inner barrier wall 46. The operator can also easily monitor the location of both the catch flange 48 above the roadway and of the outer shoe 56 on the shoulder. This easy and constant visibility allows the operator to make adjustments, such as those previously described, and adjustments to travel speed and steering.

For the tractor drawn implementation of the invention, the auger-grinder drive link includes a 90 degree, rotary transmission 62 that is drivingly connected at its output to the axle 28. The input to the transmission 62 is connected to a drive shaft 64 that has its opposite end fitted with a coupling 65 suitable for connection to the power take off shaft of a tractor. As illustrated, the drive shaft 64 has multiple legs connected together in series in the conventional manner by universal joints. Although the axle 28 can be driven in rotation by a variety of commonly known prime movers and transmission systems, we have found that a direct mechanical drive from the power take off shaft of a tractor works considerably better and less expensively than any other drive, such as a hydraulic motor drive.

A direct mechanical drive from the power take off shaft of a tractor is particularly effective if the auger-grinder 24 is formed as a double helix. A double helix auger has two helical vanes, wound within each other and 180° out of phase. For this purpose, a second helical vane 66 is also fixed to the rotatable axle 28 with a plurality of teeth attached to and outwardly protruding from the outer peripheral edges of the second helical vane 66 in the same manner as the teeth on the first helical vane 26. The second helical vane 66 is 180° out of phase with but interposed within the first helical vane 26 so that the first and second helical vanes form a double helical auger. We have found, after several experimental attempts, that the auger-grinder 24 works particularly well with two double helical vanes each having a pitch of approximately 12 inches (and therefore 6 inches between them) and driven at the normal tractor power take off speed of 540 rpm through a transmission 62 that has a 1:1 drive ratio. We believe, however, that a variation of this pitch and/or speed by 20% in either direction would retain acceptable operational results. Consequently, the double helix auger allows the advantages that (1) a transmission with a 1:1 transmission ratio can be used, (2) the machine can be operated at the conventional angular speed of a tractor PTO shaft, (3) the auger moves material approximately 12 inches for each revolution but at twice the sideward transport rate of a single auger vane with a 12 inch pitch because there are two auger vanes, and (4) more teeth can be mounted to the peripheral edges of the double helix auger because there is more peripheral edge.

Operation

As previously stated, the purpose of embodiments of the invention is to restore the roadway shoulder to a desirable level and grade without requiring additional fill material or the labor for placing and leveling and grading it. After observing the condition of the pre-existing shoulder, the operator adjusts the vertical position of the outer leg 54 so that the teeth 30 of the auger-grinder 24 extend below the level of the shoe 56 by an amount that the operator estimates will provide enough shoulder material to bring the shoulder to the desirable grade and level. The operator also adjusts the tilt of the blade 18, and therefore of the entire grinding and material moving unit 22 that is carried on the blade 18, to a grade that is steeper than the desired finished shoulder grade. The blade tilt should be steeper by an amount that allows subsequent compression of loosened shoulder material to the bring the surface of the restored shoulder to the desired grade and level. To do that, the blade 18 is laterally inclined to the roadway so that it is lower at its outer end than at its inner end. The teeth at the outer end of the auger-grinder 24 extend downward below the axis of the axle 28 a distance that is greater than the downward position of the outer shoe 56. The position the inner barrier wall 46 is adjusted so the catch flange 48 is positioned at the desired height above the roadway, typically 3 to 5 inches.

The appropriate adjustment is illustrated in FIG. 10. As seen in FIG. 10, the pre-existing shoulder material is ground-up and removed from an outer strip 67 of the pre-existing shoulder. The ground up shoulder material is transported by the helical vanes of the auger-grinder 24 toward the roadway where it is deposited along an inner strip 69 of shoulder adjacent the roadway. That leaves the outer strip 67 of the shoulder with a relatively thin layer of loosened shoulder material. The strip 69 of shoulder along the inner portion of the shoulder adjacent the roadway is left filled with loose shoulder material to a level higher than the surface 16 of the roadway. The inner strip 69 of loose material is then compacted down to the level of the roadway. We have found that the inner strip can be easily compacted by simply running over it with the tires on a dump truck, although a pavement roller can alternatively be used.

Ordinarily some initial trial and error testing is needed in order to remove enough material from the outer strip 67 of the shoulder to fill the inner strip 69 of the shoulder to the desired level before compaction. The amount of material removed from the outer strip 67 can be increased by raising the outer leg 54 so that the teeth 30 will dig deeper into the pre-existing shoulder. Conversely, the outer leg 54 can be lowered so the teeth 30 dig shallower. The lateral inclination of the entire blade 18 and grinding and material moving unit 22 can be adjusted to increase or decrease the depth of the cut into the shoulder along the outer strip 67 but that also varies the grade.

As the operator drives the machine along a shoulder, a buildup 68 of loosened shoulder material accumulates ahead of the auger-grinder 24. An additional buildup 70 also accumulates ahead of the auger-grinder 24 next to the inner barrier wall 46 because the auger-grinder 24 is transporting material inward toward the inner barrier wall 46. The forward extending wall retains shoulder material that accumulates and builds up ahead of the operating auger-grinder 24 against flowing laterally inwardly onto the roadway. The operator must continuously observe these buildups and maintain a constant amount of accumulation that is high enough to assure that the grader blade 18 smoothly levels the entire surface of the material especially at the desired height above the roadway. The buildup should neither increase nor decrease as the machine travels along the shoulder. The buildup should be maintained higher than the bottom edge of blade 18 so the surface of the loosened shoulder material is smoothly leveled and graded by the blade.

Figure 11:
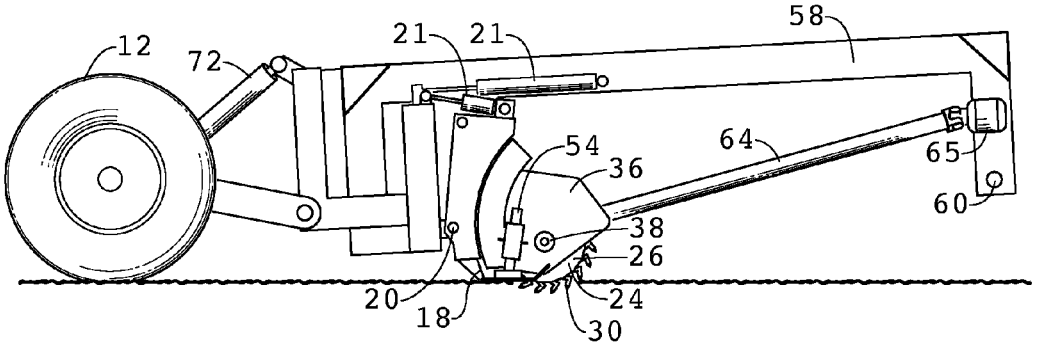
FIG. 11 is a view in side elevation of the embodiment illustrated in FIGS. 1-3 but adjusted so that the auger-grinder component of the invention penetrates further into a roadway shoulder.
Figure 12:
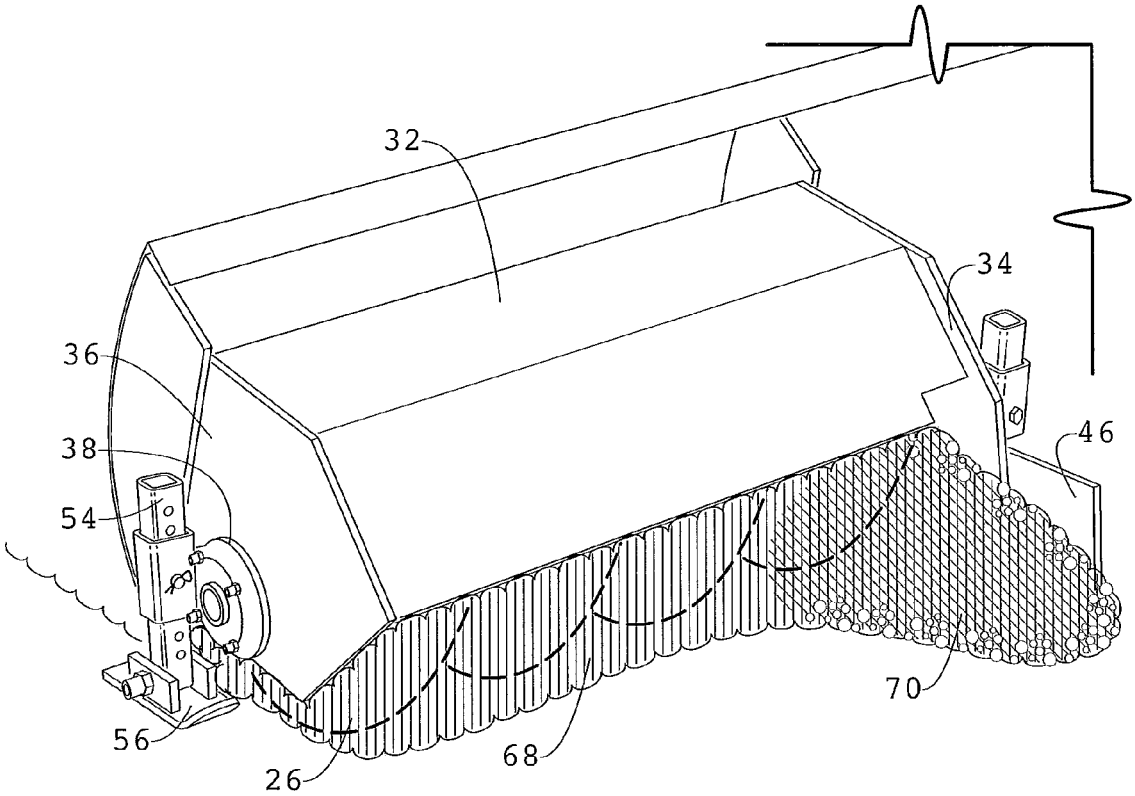
FIG. 12 is a view in perspective of the shoulder grinding and material moving unit component of the invention illustrated in FIG. 4-6 showing it in operation.

If the amount of shoulder material that is being dug up by the auger-grinder 24 is insufficient to fill the inner strip 69 of the shoulder to the desired level above the roadway, the depth that the teeth 30 cut down into the pre-existing shoulder can be increased by pivoting the auger-grinder 24 further down into shoulder. For this purpose, the blade 18 is pivotally mounted to the frame 10 for pivotal movement around a transverse axis at the hinge pins 20. As illustrated at FIG. 11 the blade 18 can be tilted forwardly and downwardly, pivoting about the hinge pin 20, to lower the auger-grinder 24 relative to the bottom edge of the blade 18. Because the hinge pin 20 is near the bottom of the blade 18, the auger-grinder 24 moves downward considerably further than the blade 18 so that the auger-grinder 24 will cut deeper into the shoulder but the level of the surface of the finished loosened material is not significantly changed. This allows vertical adjustment of the depth of the cut into the shoulder to provide additional shoulder material to be transported toward the roadway.

After the operator is satisfied with the adjustments, he continues to observe the accumulated buildup ahead of the auger-grinder 24 and adjacent the inner barrier wall 46. Readjustments are made as needed raising the blade 18 and the grinding and material moving unit 22 if too much if too much material is building up so as not to dig in as deep and lowering them if too little is building up. A normal grader permits it blade to be raised and lowered vertically for adjusting the depth of its cut and for traveling without ground contact. That is, for example, accomplished by a hydraulic cylinder 72 that raises and lowers the wheel axles 74. That provides an additional adjustment that simultaneously raises or lowers the level of the blade 18 and the entire grinding and material moving unit 22.

We have found from road testing our prototype machine that the machine can restore a roadway shoulder by running along the road at a speed of 1 to 2 miles per hour, which is considerably faster than the conventional manner of repairing a roadway shoulder.

LIST OF REFERENCE NUMBERS

10 support frame
12 wheels of support frame
14 direction of travel
16 roadway surface
18 grader blade
20 hinge pins (for pivot of blade around transverse axis)
21 hydraulic cylinders
22 shoulder grinding and material moving unit
24 auger-grinder
26 first helical vane
28 rotatable axle (for auger)
30 teeth on auger vanes
32 shielding shroud
34 inner shroud end wall
36 outer shroud end wall
38 axle bearings
40 beater
42 paddles on beater
44 circular plate of beater
46 inner barrier wall (adjustable)
48 catch flange
50 outer tube of inner jacks
52 jack inner tube
54 outer leg
56 shoe of outer leg
58 tongue of frame
60 hitch on tongue
62 90° rotary transmission
64 drive shaft (to PTO)
65 PTO coupling
66 second helical vane
67 outer strip of shoulder
68 material buildup in front of auger-grinder
69 inner strip of shoulder
70 additional material buildup adjacent the inner barrier wall
72 hydraulic cylinder to raise/lower entire blade by pivoting wheel
74 wheel axle for support frame wheels This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. A machine for restoring a roadway shoulder from concurrently reclaimed shoulder material, the machine including a support frame movable in a direction of travel along a roadway and further comprising:

(a) a grader blade mounted to the support frame, oriented transversely of the direction of travel and adjustably rotatable about an axis along the direction of travel for tilting the blade with respect to the transverse contour of the roadway;

(b) an auger-grinder mounted to the grader blade or the support frame and comprising an auger having a first helical vane fixed to a rotatable axle with a plurality of teeth attached to and protruding outwardly from the auger wherein the teeth are fixed to and along outer peripheral edges of the helical vane;

(c) a shroud mounted above and partially surrounding the auger-grinder and having an inner shroud end wall, an outer shroud end wall and bearings in which the axle is journaled between the end walls transverse to the direction of travel;

(d) a beater fixed to the axle between an inner end of the helical vane and the inner wall, the beater having a plurality of paddles extending outwardly from the axle;

(e) an inner barrier wall attached to the inner shroud wall and extending forward of the auger-grinder, wherein a catch flange is attached to the inner barrier wall aligned along the direction of travel and extending laterally outwardly in the direction of the auger-grinder, the inner barrier wall being vertically adjustable for fixing the flange at a selected distance lower than radial extremities of the beater;

(f) a drive link connected to the axle for connection to a prime mover for driving the axle in rotation; and (g) a downwardly extending vertically adjustable outer leg attached to the outer shroud wall and having a shoe pivotally mounted at a bottom end, the outer leg shoe for riding along the shoulder outwardly of the auger-grinder for permitting adjustment of the distance between the pre-existing shoulder surface and the depth of the auger-grinder teeth below the pre-existing shoulder surface;

wherein, in an operable orientation, the blade is laterally inclined to the roadway and lower at its outer end than its inner end and wherein the teeth at the outer end of the auger-grinder extend downward below the axis of the axle a distance that is greater than the downward position of the shoe that is attached to the outer leg.

2. A machine in accordance with claim 1 and further comprising a second helical vane fixed to the rotatable axle with a plurality of teeth attached to and outwardly protruding from the outer peripheral edges of the second helical vane, the second helical vane being 180° interposed within the first helical vane so that the first and second helical vanes form a double helix.

3. A machine in accordance with claim 2 wherein the beater has four radially oriented paddles arranged with a 90° angular spacing.

4. A machine in accordance with claim 3 wherein the support frame has a tongue with a hitch for attachment to and for being pulled by a tractor and wherein the drive link comprises a 90 degree transmission drivingly connected at a transmission output to the axle and having a drive shaft connected at one end to a transmission input, the opposite end of the drive shaft having a coupling for connection to the power take off shaft of the tractor.

5. A machine for restoring a roadway shoulder from concurrently reclaimed shoulder material, the machine including a support frame movable in a direction of travel along a roadway and further comprising:

(a) a grader blade mounted to the support frame, oriented transversely of the direction of travel and adjustably rotatable about an axis along the direction of travel for tilting the blade with respect to the transverse contour of the roadway, the blade being pivotally mounted to the frame for pivotal movement around a transverse axis;

(b) an auger-grinder mounted to the grader blade or the support frame and comprising an auger having a first helical vane fixed to a rotatable axle with a plurality of teeth attached to and protruding outwardly from the auger wherein the teeth are fixed to and along outer peripheral edges of the helical vane;

(c) a shroud mounted above and partially surrounding the auger-grinder and having an inner shroud end wall, an outer shroud end wall and bearings in which the axle is journaled between the end walls transverse to the direction of travel;

(d) a beater fixed to the axle between an inner end of the helical vane and the inner wall, the beater having a plurality of paddles extending outwardly from the axle;

(e) an inner barrier wall attached to the inner shroud wall and extending forward of the auger-grinder, wherein a catch flange is attached to the inner barrier wall aligned along the direction of travel and extending laterally outwardly in the direction of the auger-grinder, the inner barrier wall being vertically adjustable for fixing the flange at a selected distance lower than radial extremities of the beater;

(f) a drive link connected to the axle for connection to a prime mover for driving the axle in rotation; and (g) a downwardly extending vertically adjustable outer leg attached to the outer shroud wall and having a shoe pivotally mounted at a bottom end, the outer leg shoe for riding along the shoulder outwardly of the auger-grinder for permitting adjustment of the distance between the pre-existing shoulder surface and the depth of the auger-grinder teeth below the pre-existing shoulder surface.

6. A machine in accordance with claim 5 wherein (a) a second helical vane fixed to the rotatable axle with a plurality of teeth attached to and outwardly protruding from the outer peripheral edges of the second helical vane, the second helical vane being 180° interposed within the first helical vane so that the first and second helical vanes form a double helix;

(b) the support frame has a tongue with a hitch for attachment to and for being pulled by a tractor and wherein the drive link comprises a 90 degree transmission drivingly connected at a transmission output to the axle and having a drive shaft connected at one end to a transmission input, the opposite end of the drive shaft having a coupling for connection to the power take off shaft of the tractor;

(c) in an operable orientation, the blade is laterally inclined to the roadway and lower at its outer end than its inner end and wherein the teeth at the outer end of the auger-grinder extend downward below the axis of the axle a distance that is greater than the downward position of the shoe that is attached to the outer leg; and (d) in an operable orientation, the flange of the inner barrier wall is at least one inch above the roadway.

7. A machine in accordance with claim 6 wherein the 90 degree transmission has a drive ratio of 1:1 for driving the axle at the angular speed of the tractor power take off shaft.

* * * * *